United States Patent [19]

Carnahan et al.

[11] Patent Number: 4,944,058

[45] Date of Patent: Jul. 31, 1990

[54] INTEGRATED MATTRESS AND FLUSH COMMODE

[76] Inventors: Monte Carnahan; Gayle A. Carnahan, both of 100 W. Cedar, Wilburton, Okla. 74578

[21] Appl. No.: 439,849

[22] Filed: Nov. 20, 1989

[51] Int. Cl.[5] ..... A61G 7/02

[52] U.S. Cl. ..... 5/90; 4/235; 4/237; 4/239; 4/DIG. 18; 5/463

[58] Field of Search ..... 5/463, 90, 60; 4/239, 4/237, 235, 452, DIG. 18; 128/853, 850

[56] References Cited

U.S. PATENT DOCUMENTS

| | | | |
|---|---|---|---|
| 169,705 | 4/1875 | Huntress | 5/90 |
| 787,162 | 4/1905 | Feely | 5/90 |
| 793,061 | 6/1905 | Dugan | 5/90 |
| 876,238 | 1/1908 | Rode | 5/90 |
| 1,604,205 | 10/1926 | Tiffany | 5/463 |
| 2,418,259 | 4/1947 | Marmanson | 5/90 |
| 3,671,981 | 6/1972 | Smith | 4/239 |
| 4,244,066 | 1/1981 | Rukawina | 5/463 |

*Primary Examiner*—Alexander Grosz

*Attorney, Agent, or Firm*—Ross, Howison, Clapp & Korn

[57] ABSTRACT

A bed with an integrated commode includes a mattress (10) and bed frame with a hole (26) disposed therein. The hole (26) is operable to receive the outer peripheral edge of the commode seat (14). A sanitary insert (12) is provided which has an upper surface (24) that is disposed over the mattress (10) or moisture-proof mattress cover and attached thereto by a hook and loop type attachment device (28). The sanitary insert (12) extends downward into the interior of the bowl with a downward extending portion (30). A commode seat (14) is operable to be disposed on the upper surface of the rim (22) and hold the sanitary insert (12) therein. The seat (14) has a splash guard (16) that extends from the interior surface thereof downward into the bowl.

12 Claims, 4 Drawing Sheets

FIG. 2
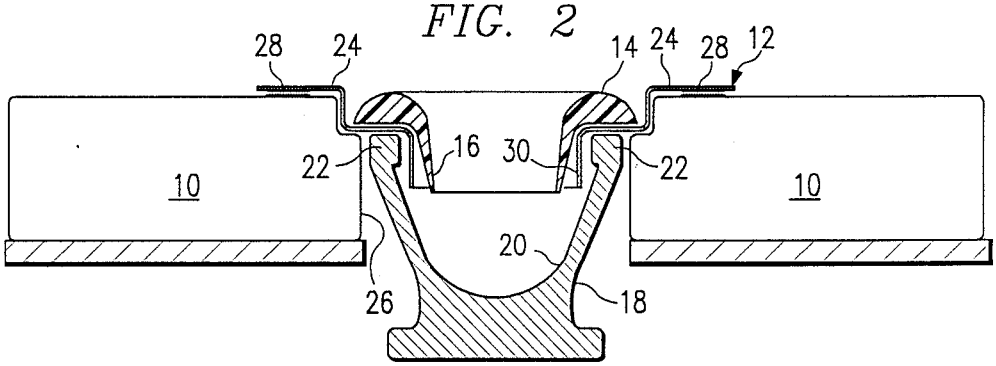
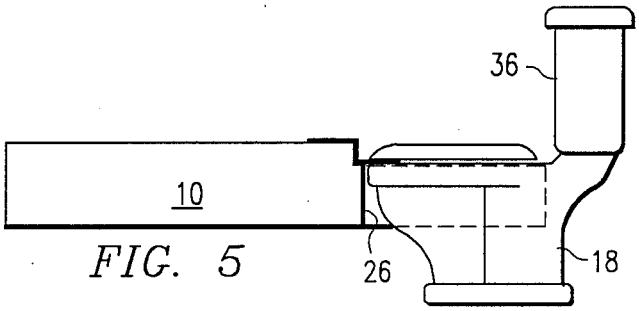
FIG. 5
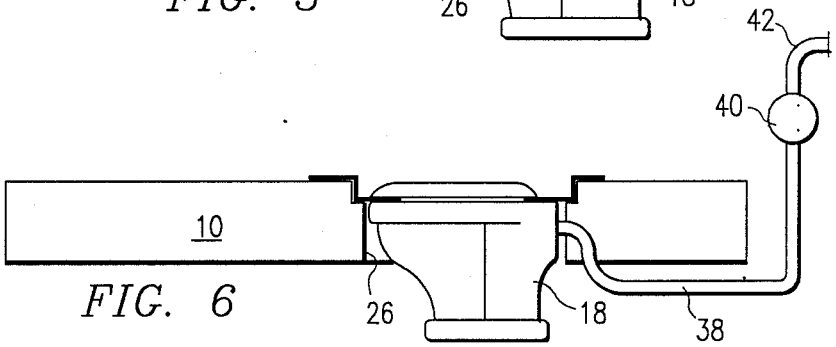
FIG. 6
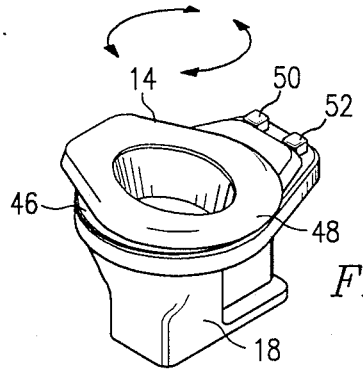
FIG. 7

INTEGRATED MATTRESS AND FLUSH COMMODE

TECHNICAL FIELD OF THE INVENTION

The present invention pertains in general to a combination of a mattress bed frame and a commode insert, and more particularly, to the interface between the commode and the mattress, and to the swiveling mechanism of the commode seat.

BACKGROUND OF THE INVENTION

Traditional devices such as bedpans are often used for patients or elderly individuals in nursing homes and elderly or other individuals confined to bed at home or individuals having balance problems thus subject to falling and necessitating the need for someone to be with them. However, these devices usually require the dependency of the patient or elderly individual on the nursing staff of an institution, or on care providers at home. Other conventional devices known in the art require that the patients be displaced relative to their beds, or leave their beds, in order to enable them to use the toilet in a seated, normal upright position.

Devices that have integrated a commode with the actual bed itself have been overly complicated. For example, in U.S. Pat. No. 3,959,833, issued to Burke et al., an insert is provided whereby a portion of the mattress is removed and a portable commode is inserted therefore. However, the individual is required to assist in positioning this commode in the bed. This type of system does not facilitate connection to plumbing sanitary waste of domestic water lines and still requires some other type of intervention by the nursing staff, or care provider.

SUMMARY OF THE INVENTION

The present invention disclosed and claimed herein comprises a bed with an integrated commode which includes a mattress bed frame with a hole disposed therethrough to receive the upper portion of the commode therein. The upper surface of the commode seat is proximate to the same plane as the upper surface of the bed. The hole is approximately the same size as the outer peripheral edge of the commode seat. A sanitary insert is provided for being disposed about the periphery of the upper lip of the commode. The sanitary insert includes a flat surface for being disposed on the surface of the mattress and about the hole therein. The flat surface extends from points distal to the rim of the commode to the interior edge of the rim of the commode. A downwardly extending surface is provided that is cylindrical in shape and extends from the interior edge of the rim of the commode and attached to the flat surface and extends downward into the bowl on the interior surface thereof. An attachment device is provided for attaching the outer peripheral edges of the flat surface to the mattress or moisture-proof mattress cover on the upper surface thereof. A commode seat is provided that is "polarized" to provide a proper anatomical accommodation and configured to fit over the peripheral edge of the commode.

In another aspect of the present invention, a splash guard is provided that is a cylindrical shaped, semi-rigid surface that extends downward from the interior peripheral edge of the commode seat to the interior bowl.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a cross-sectional diagram of the commode and mattress;

FIG. 5 illustrates a cross-sectional side view of one embodiment of the present invention utilizing a tank type commode;

FIG. 6 illustrates a side cut-away view of an alternate embodiment of the present invention utilizing a flush valve;

FIG. 7 illustrates a detail of the swivel operation of the commode seat for use with the tank-type and/or flush valve system in the supine position;

DETAILED DESCRIPTION OF THE INVENTION

Figure 1:
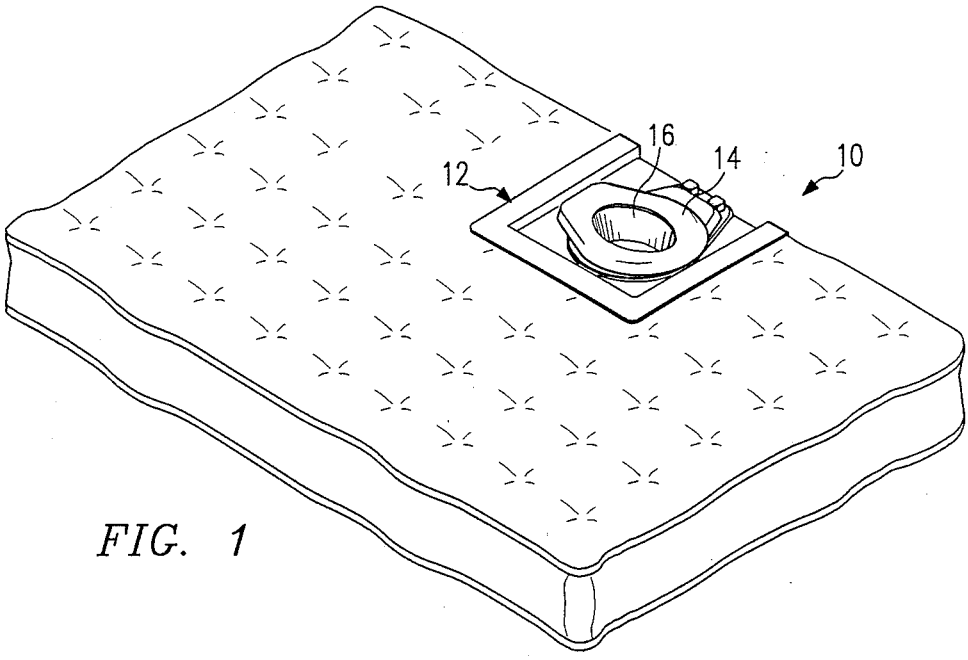
FIG. 1 illustrates a perspective view of the integrated commode and mattress.

Referring now to FIG. 1, there is illustrated a perspective view of the mattress 10 in which a commode is inserted. The commode is hidden by the mattress and is not shown in FIG. 1. A sanitary insert 12 is provided which is operable to be disposed over an opening (not shown) in the mattress 10. The sanitary insert has a flat portion that is operable to be disposed on the surface of the mattress 10 or moisture-proof mattress cover adjacent the periphery of the opening in the mattress 10. The sanitary insert 12 also has a vertical portion that is operable to be disposed downward into the opening to provide a seal and extend into the opening of the commode. A commode seat 14 is provided which is operable to be disposed over the sanitary insert, the commode seat 14 having a splash guard 16 extending downward from the interior rim thereof into the commode.

Referring now to FIG. 2, there is illustrated a cross-sectional diagram of the mattress 10 and a commode 18. The commode 18 has an interior 20 and an upper rim 22. The upper surface of the mattress 10 or moisture-proof mattress cover is approximately one inch higher than the upper surface of the commode seat 14. In this manner, the weight of an individual on the mattress 10 proximate to the commode seat 14 results in compression of the mattress 10 to approximately the level of the commode seat 14, thus enabling the individual to easily move from the mattress 10 to the commode seat 14.

The sanitary insert 12 has an upper flat surface 24 extending from an opening 26 in the mattress 10 away from the edge thereof. The flat surface 24 is attached to the mattress 10 or moisture-proof mattress cover by a hook and loop type attachment 28 around the peripheral edges of the flat surface 24. The sanitary insert 12 has a vertical portion 30 that extends downward into the commode and over the upper lip 22. The sanitary device 12 is a water repellent material such that any fluids and the such that fall on the upper surface of the sanitary device 12 will fall downward into the interior 20 of the commode 18 and will not go between the commode 18 and the mattress 10 through the opening 26. This provides an increased moisture barrier.

The commode seat 14 is operable to be disposed over the sanitary device 12 and in adjacent contact with the lip 22 such that it holds sanitary device 12 in secure contact with the upper lip 22 of the commode 18. The splash guard 16 is typically fabricated of a hard plastic material which can be cleaned and extends downward essentially the same distance as the vertical portion 30 of the sanitary insert 12. The sanitary insert 12 is, in the preferred embodiment, an acetate tricot laminated to a vinyl back. This is designed to be a disposable or washable material that can be removed and disposed of or washed whenever it becomes soiled. A new or clean insert can then be disposed over the opening between the seat 14 and the upper lip 22.

Figure 3:
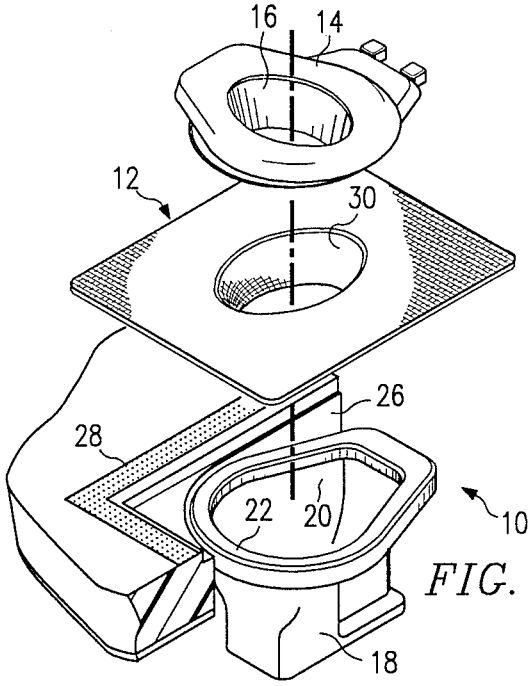
FIG. 3 illustrates a blow-up view of the sanitary insert, the commode seat and the commode, with a cut-away view of the mattress.

Referring now to FIG. 3, there is illustrated a blow-up of the commode seat 14, the sanitary insert 12 and the commode 18 with a cut-away of the bed 10. It can be seen that the hook and loop type strips 28 are formed on the surface of the bed 10 or moisture-proof mattress cover and the sanitary insert 12 is first disposed down over the opening 26 and the interior 20 of the commode 18, thus providing a waterproof seal over the lip 22 of the commode 18. The hook and loop type strips 28 are then attached to prevent the movement of the sanitary insert 12 and then the commode seat 14 disposed through the opening in the sanitary insert 12 such that the splash guard 16 is disposed adjacent the portion 30 of the sanitary insert 12 and completely surrounded thereby. Similarly, the sanitary insert 12 can be removed by reversing this process.

Figure 4:
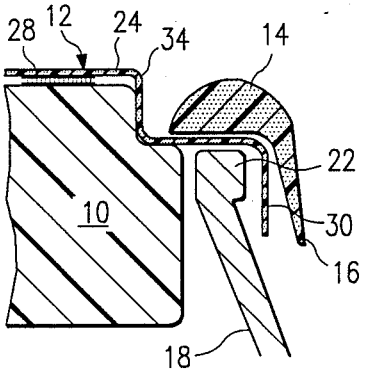
FIG. 4 illustrates a detail of the sanitary seal provided by the sanitary device and the commode seat.

Referring now to FIG. 4, there is illustrated a detailed view of the installation of the sanitary insert 12 illustrating in detail one of the upper lips 22 of the commode 18 and the seal formed by the sanitary insert 12 between the commode lid 14 and the upper lip 22. The sanitary insert 12 can either be formed from a single molded piece of material or, more preferably, it is formed from two portions, flat portion 24 and downwardly extended portion 30, sewn together at a point 34. As described above, this is a disposable or washable insert and may be changed or washed, respectively, only when needed. The splash guard 16 prevents excessive soiling of the downwardly extended portion 30, thus reducing the need for changing or washing on a frequent basis.

Referring now to FIG. 5, there is illustrated one embodiment of the installation of the commode 18 and the mattress 10. A tank-type commode can be utilized which has a supply tank 36 disposed on the back thereof. With this type of system, the commode must be disposed adjacent the edge of the bed such that a tank can protrude upward therefrom. Therefore, the opening 26 would be disposed at one edge of the mattress 10.

Referring now to FIG. 6, in an alternate embodiment of the present invention, the commode 18 operates on a flush valve. Therefore, the commode 18 can be disposed in any location within the periphery of the mattress 10 and a water line 38 routed over to a flush valve 40 which goes to a water supply through a pipe 42. The flush valve 40 allows sufficient pressure to be routed to the commode 18 to provide the flushing action. However, the commode 18 should still be disposed adjacent the edge of the bed to allow adequate sleeping space capability, and to enable the patient to use toilet in a seated upright position. Additionally, the flush valve 40 must be located in an easily accessible location. Alternatively, the flush valve 40 could be replaced by a water closet (not shown) that would be disposed at a height sufficient to generate enough pressure for the flushing operation.

Referring now to FIG. 7, there is illustrated a swiveling mechanism for the commode seat 14. Typically, the commode 18 must be oriented to accommodate the water lines, the soil pipe, etc. However, commode seats are "polarized" to provide a proper anatomical accommodation. Most commode seats are configured for an upright sitting position whereas the present invention is utilized in a supine position to accommodate a more comfortable position for those individuals unable to sit in an upright position. The commode seat 14 preferably is foam padded. As such, the commode seat may not be oriented in the right direction and, therefore, the swiveling seat of FIG. 7 is provided. The seat 14 is comprised of a bottom portion 46 and an upper portion 48. The bottom portion 46 has two hinged brackets 50 and 52 which are normally found on a commode seat. These interface with the commode itself in a conventional manner. The upper portion 48 swivels about the bottom portion 46. In the preferred embodiment, this utilizes a slot-and-eye bolt with the eye-bolt being driven from the other side of the upper portion 48 and the slot being positioned in the lower portion 46. Alternatively, variously pre-drilled holes can be provided for the downwardly directed bolt (not shown), such that the seat can be positioned in a number of predetermined orientations. The primary object of the seat of FIG. 7 is to provide different orientations which can be provided by either a pivoting/locking mechanism or by pre-drilled holes.

Figure 8:
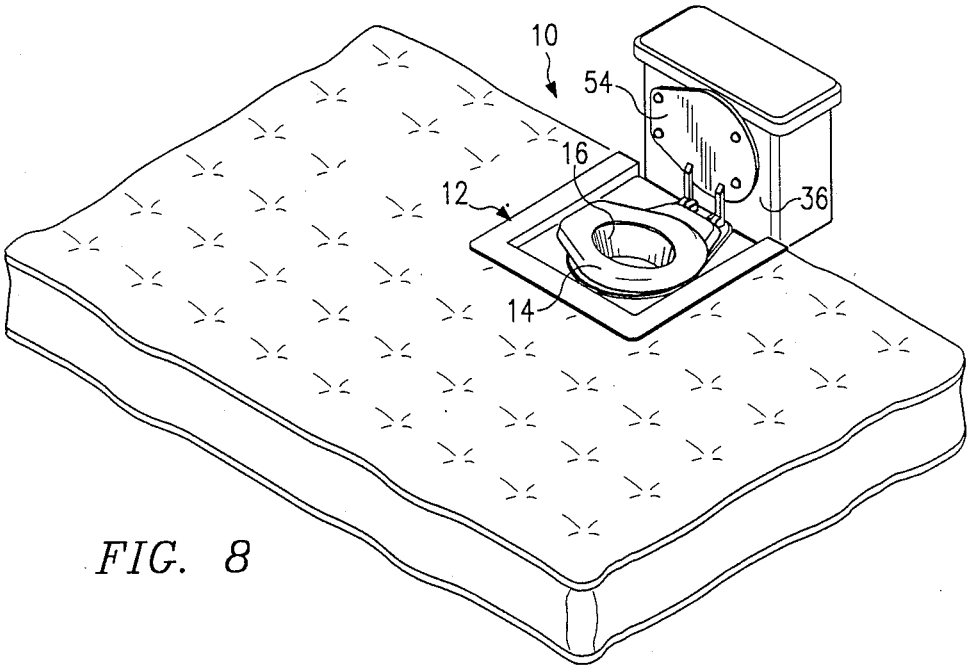
FIG. 8 illustrates an alternate embodiment for utilization with a cover.

Referring now to FIG. 8, there is illustrated an alternate embodiment of the closed seat of FIG. 1. In the embodiment of FIG. 8, a cover 54 is provided which is operable to be raised and lowered relative to the tank 36 and cover the seat 14. In this manner, the opening in the commode can be covered.

Figure 9:
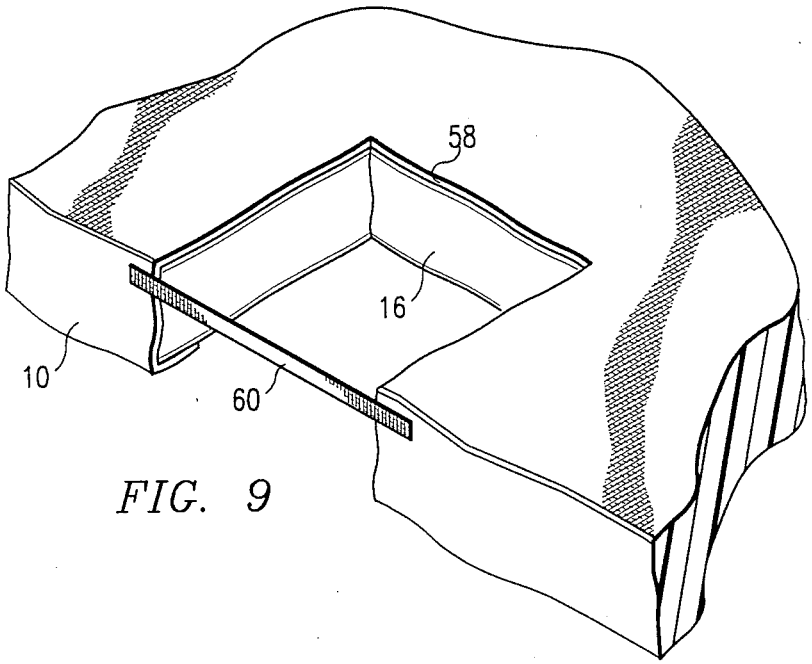
FIG. 9 illustrates the attachment of the mattress cover in the slot formed in the mattress.

Referring now to FIG. 9, there is illustrated a detail of the slot formed in the mattress 10. A mattress cover 58 is provided which is sized to allow the slot to be opened. The slot is formed on the edge of the mattress 10 and on the open end of the slot, there is provided a restraining strap 60, the restraining strap 60 attaches to the mattress cover on either side of the opening in the edge of the mattress 10. This allows the tank type or flush valve commode to be disposed therein and retain the original shape of the mattress cover 58.

Figure 10:
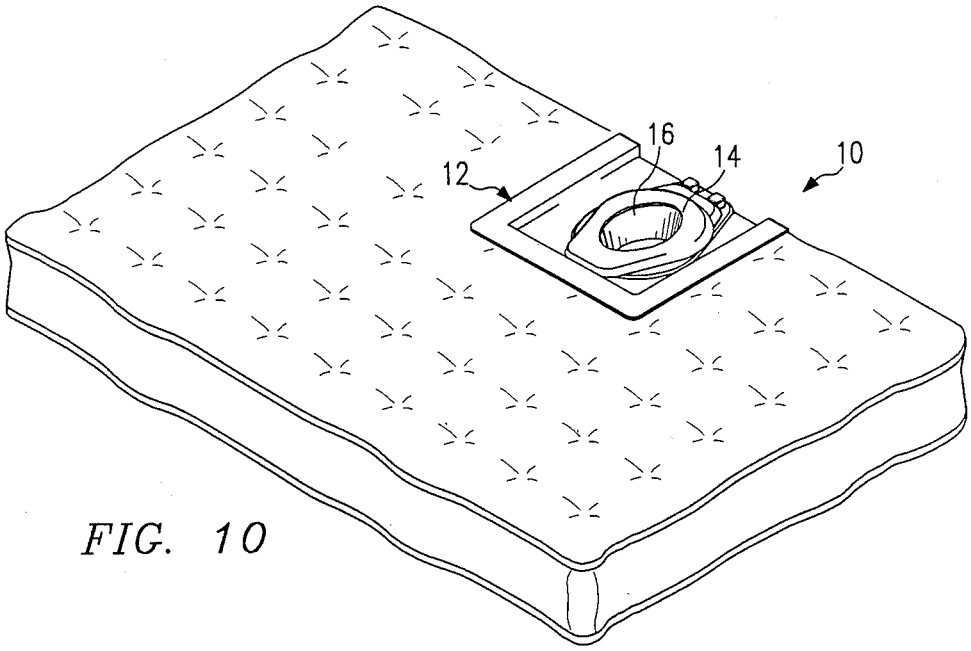
FIG. 10 illustrates an embodiment wherein the commode seat is disposed on the edge of the mattress and oriented such that it facilitates use in the seated normal upright position.

Referring now to FIG. 10, there is illustrated an alternate embodiment of the present invention. The commode seat 14 is illustrated as being disposed at a 180° angle with respect to the normal orientation. This facilitates use with the legs draped over the side of the bed and in a seated upright position. The flush valve commode 18 of FIG. 6 would be preferred for this embodiment, which would be disposed adjacent the edge of the bed. However, the tank type commode can still be used effectively in the event water pressure is not adequate to use the flush valve commode.

In summary, there has been provided an integrated bed and commode with a sanitary insert. The bed is provided with a hole in the mattress and bed frame and the commode disposed within the hole. An insert is provided which extends over the surface of the mattress and down into the commode to provide a waterproof seal at the peripheral edges thereof. A commode seat is provided with a splash guard that extends downward from the interior rim thereof. The commode seat is disposed over the sanitary insert. The sanitary insert is disposable or washable upon soilage thereof.

Although the preferred embodiment has been described in detail, it should be understood that various changes, substitutions and alterations can be made therein without departing from the spirit and scope of the invention as defined by the appended claims.

What is claim is:

1. A bed with an integrated flush commode, comprising:

a mattress and bed frame with a hole disposed therethrough to receive the upper portion of the flush commode such that the upper surface of the flush commode is proximate to the same plane as the upper surface of the mattress, the hole approximately the same size as the outer peripheral edge of the flush commode on the upper end thereof;

a sanitary insert disposed about the upper lip of the bowl of the flush commode, said sanitary insert having:

a flat surface disposed on the surface of said mattress and about the hole therein and extending from points distal to the rim of the flush commode bowl to the interior of the rear edge of the flush commode bowl, a downwardly extending surface being cylindrical in shape and extending from the interior edge of the rim of the flush commode bowl and downward into the flush commode bowl on the interior surface thereof, and means for attaching said flat surface to the surface of said bed on the outer peripheral edges of the flat surface; and a commode seat configured to fit over the rim of the flush commode bowl and overlying the portion of said sanitary insert disposed over the rim of the flush commode bowl; and a splash guard configured as a cylindrically shaped semi-rigid surface having the peripheral edges on one end thereof attached to the inner peripheral edge of said commode seat, the surface of said splash guard extending downward into said flush commode bowl.

2. The apparatus of claim 1 wherein said means for attaching said sanitary insert to the surface of said mattress comprises a Velcro material, one portion of said hook and loop type material attached to the undersurface of said flat surface of said sanitary insert and the other portion of said material being attached to the upper surface of said mattress.

3. The apparatus of claim 1 wherein said sanitary insert is fabricated of a moisture-proof material.

4. The apparatus of claim 1 wherein said sanitary insert comprises a single piece of material.

5. A bed with an integrated flush commode, comprising:

a mattress and bed frame with a hole disposed therethrough to receive the upper portion of the flush commode and such that the upper surface of the flush commode is proximate to the same plane as the upper surface of the mattress, the hole approximately the same size as the outer peripheral edge of the flush commode;

a sanitary insert for being disposed about the upper lip of the bowl, said sanitary insert having:

a flat surface disposed on the surface of said mattress and about the hole therein and extending from points distal to the rim of the flush commode bowl to the interior of the rear edge of the flush commode bowl, a downwardly extending surface being cylindrical in shape and extending from the interior edge of the rim of the flush commode bowl and downward into the bowl on the interior surface thereof, and means for attaching said flat surface to the surface of said bed on the outer peripheral edges of the flat surface;

a commode seat configured to fit over the rim of the flush commode bowl and overlying the portion of said sanitary insert disposed over the rim of the flush commode bowl; and said commode seat comprised of first and second portions, said first portion operable to be disposed over the rim of the flush commode bowl and said second portion being rotatably mounted with respect to said first portion.

6. The apparatus of claim 1, wherein the upper surface of the bed is slightly higher than the upper surface of the commode seat, such that compression thereof due to the weight of an individual thereon will result in the upper surface of the mattress being substantially in the same plane as said commode seat.

7. The apparatus of claim 1, wherein the upper surface of said mattress has a moisture-proof mattress cover disposed thereover.

8. The apparatus of claim 1, wherein the flush commode is disposed on the edge of the mattress and said commode seat is polarized to face the edge of the mattress.

9. The apparatus of claim 1, wherein the flush commode is disposed on the edge of the mattress and said commode seat is polarized to face the foot of the mattress.

10. A method for integrating a flush commode with a bed, comprising the steps of:

providing a mattress and bed frame;

forming a hole in he mattress and bed frame substantially the same dimension as the outer peripheral edge of the upper rim of the flush commode;

disposing a flat moisture proof membrane over the surface of the mattress about the hole and extending from points distal to the rim of the flush commode bowl to a point proximate to the inner edge of the rim of the flush commode bowl to provide a moisture proof barrier over the space between the outer peripheral edge of the flush commode bowl and the edge of the opening; and disposing a commode seat on the rim of the flush commode bowl and overlying the moisture proof barrier;

extending a cylindrical shaped moisture proof membrane downward from the portion of the flat membrane on the interior edge of the flush commode bowl to the interior surface of the flush commode bowl; and disposing a cylindrical semi-rigid shaped surface on the interior edge of the seat of the flush commode extending from the interior peripheral edge thereof downward into the bowl.

11. The method of claim 10 wherein the flush commode seat is polarized and the hole in the mattress is formed on the edge of the mattress with the commode seat facing the edge of the mattress.

12. The method of claim 10 wherein the flush commode seat is polarized and the hole in the mattress is formed on the edge of the mattress with the commode seat facing the foot of the mattress.

* * * * *